United States Patent [19]

Yoe et al.

[11] Patent Number: 4,961,580

[45] Date of Patent: Oct. 9, 1990

[54] ROTATING BALL COLLECTING GAME

[75] Inventors: Craig S. Yoe, Croton-on-Hudson, N.Y.; Carol M. Rehtmeyer, Wheaton; Harry Disko, South Barrington, both of Ill.

[73] Assignee: Marvin Glass & Associates, Chicago, Ill.

[21] Appl. No.: 308,866

[22] Filed: Feb. 8, 1989

[51] Int. Cl.[5] ..... A63F 9/00

[52] U.S. Cl. ..... 273/1 GG; 273/DIG. 25

[58] Field of Search ..... 273/1 GG, 1 GD, 1 GC, 273/129 V, 129 R, DIG. 25

[56] References Cited

U.S. PATENT DOCUMENTS

| | | | |
|---|---|---|---|
| 606,744 | 7/1898 | St. John | 273/1 GD |
| 2,002,077 | 5/1935 | Darling et al. | 273/DIG. 25 X |
| 2,771,294 | 11/1956 | MacChesney | 273/DIG. 25 X |
| 3,578,319 | 5/1971 | Kohner et al. | 273/1 GG |
| 4,025,076 | 5/1977 | Lipps | 273/DIG. 25 X |
| 4,177,987 | 12/1979 | Zimmerman | 273/1 GG |
| 4,809,980 | 3/1989 | Bertrand | 273/DIG. 25 X |

*Primary Examiner*—Paul E. Shapiro

*Attorney, Agent, or Firm*—John S. Pacocha

[57] ABSTRACT

An action game including a receptacle styled as a bathtub having a motor driven impeller in the bottom of the bathtub. Disposed above and adjacent one end of the bathtub is a tank with a hinged lid in which a plurality of different colored balls are stored. A spigot extends from the tank over one upper edge of the bathtub providing an outlet duct for the balls to pass from the tank into the bathtub. Simultaneous release of the balls from the tank and turning on of the battery motor is controlled by a handle that pivots a gate inside the tank and completes an electrical circuit between the battery and the motor. Each player is provided with a suction cup plunger having a hollow shaft handle which the player uses to pick balls of a preselected color out of the bathtub as the balls are rotated around by the impeller.

5 Claims, 1 Drawing Sheet

10
24
30
44
27
34
2
36
14
22
25
6
2
13
56
58
16
12
13
60
6

56
58
60
36

4
42
30
44
27
28
3
46
29
3

14
34
24
40
52
26
32
36
16
18
36
15
13
13
20
21
4

42
24
30
25
28
49
46
25
48
40
34
50
32
13
13

12
14
25
15
44
46
29
27
18
16
28
50
20
49
34
24
48
25

28
48
52
40
20

ROTATING BALL COLLECTING GAME

BACKGROUND OF THE INVENTION

1. Field of the Invention

This invention relates generally to games and more particularly to object collecting action games.

2. Background Art

Action games in which players try to collect objects are old in the art. The Cadaco Division of Rapid Mounting and Finishing Company "OH NUTS!" Game includes a battery motor driven paddle at the center of a concave receptacle; players try to selectively grab colored marbles using a claw-like collecting tool as the marbles are whirled around the receptacle by the motor driven paddle. The collecting tools in the "OH NUTS!" Game are plastic tubes with flared funnel-like bottom portions from which three claw-like prongs project, the prongs spread apart when a collector is pushed down atop a marble to fit over and grab the marble. In the Parker Brothers Division of Kenner Parker Toys, Inc. "MONSTER MASH" Action Games, players use swatters carrying a suction cup to collect picture bearing cards. U.S. Pat. No. 3,643,954 issued Feb. 22, 1972 to Meyer et al. discloses a game in which a generally concave receptacle having a centrally mounted battery motor driven rotor for launching balls within the receptacle is provided with two ball feeding members in the form of diagonally opposed scoop-like trays mounted adjacent the outside of the receptacle. There remains a need for additional object collecting games that provide new and entertaining ways of introducing and collecting the objects.

SUMMARY OF THE INVENTION

The present invention is concerned with providing a ball collecting action game including a player operated control that both releases balls from a container into a receptacle with a motor driven impeller and simultaneously activates the impeller. For collecting the balls as they are rotated about the receptacle by the impeller, each player is provided with a tool that has a generally hemispherical shaped suction cup mounted on the end of a tubular shaft and simulates a plunger like that used to try to free blocked drains.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
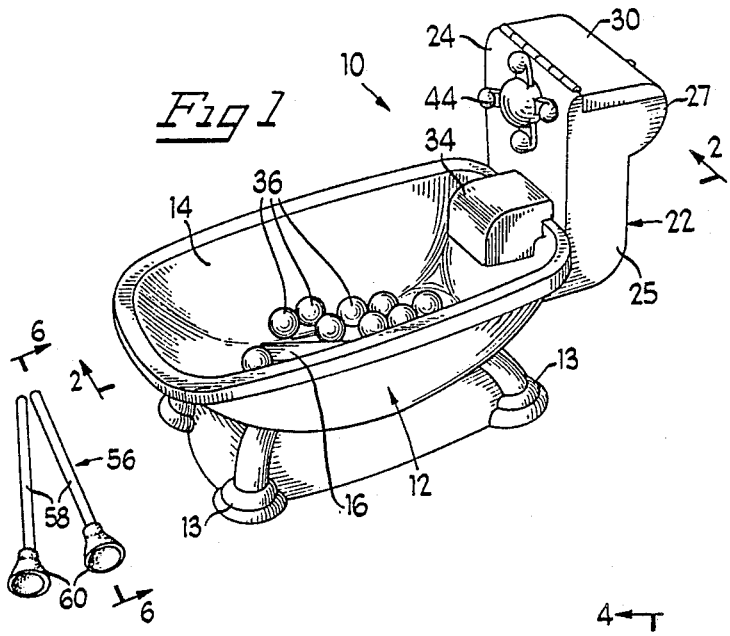
FIG. 1 is a perspective view of an embodiment of the present invention.
Figure 2:
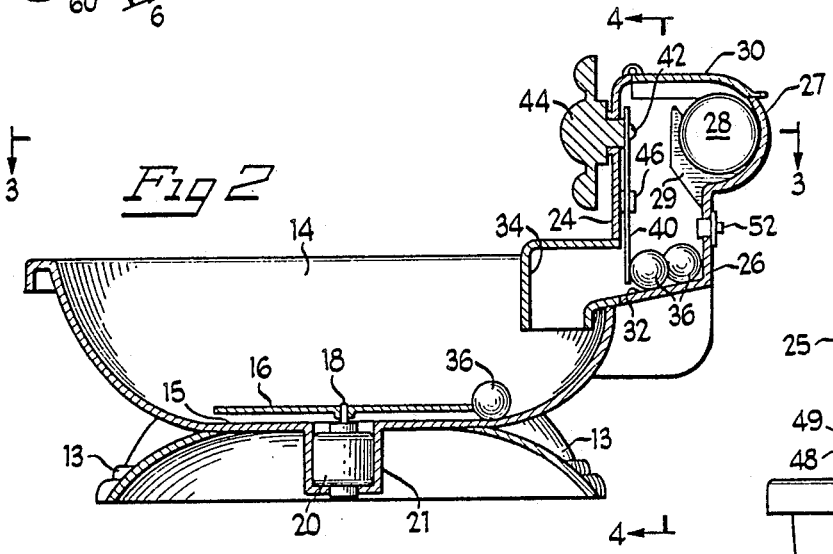
FIG. 2 is an enlarged scale, sectional view taken generally along line 2—2 of FIG. 1.

Referring now to the drawings in which like parts are designated by like reference numerals throughout the several views, FIG. 1 shows a game 10 that includes a bathtub shaped receptacle 12 including simulated legs 13. Bathtub 12 provides a generally rectangular, open top receptacle 14 with curved walls that slope downwardly toward a bottom 15. Mounted for rotation in the bottom of the bathtub is an impeller 16 that is secured directly to an output shaft 18 of a small DC motor 20. As is best illustrated in FIG. 2, motor 20 is mounted within a well 21 generally centrally disposed and integrally formed as part of the bottom of bathtub 12.

Attached to bathtub 12 adjacent one end of the open top is a container or tank 22, most of which is disposed outside of receptacle 14. Front wall 24, sidewalls 25 and the lower portion of back wall 26 of container 22 are generally planar. However, the upper part of back wall 26 has an outwardly, generally semicircular, curved portion 27. In the portion of tank 22 generally defined by sidewalls 25 and the curved portion 27 of the back wall, a battery 28 is removably mounted in a clip 29 secured to the interior of the tank. A hinged top lid 30 provides access to the interior of the tank and facilitates changing of the battery when needed.

Tank container 22 has a bottom wall 32 that slopes downwardly from back wall 26 toward front wall 24 where it meets an outlet duct 34. Conveniently, outlet duct 34 is designed to resemble a spigot and extends over an upper edge of bathtub 12 into receptacle 14. A plurality of differently colored balls 36, preferably made of plastic or some other material that does not conduct electricity, are inserted in container or tank 22 through open hinged top lid 30. As is best illustrated in FIG. 2, balls 36 are of a size that will easily pass, under the force of gravity, down through tank 22 and along its sloping bottom wall 32 into outlet duct 34 from which the balls will drop into receptacle 14. To control the release of balls 36 from container 22, a gate 40 is mounted for pivotal movement on the inside of front wall 24.

Figure 4:
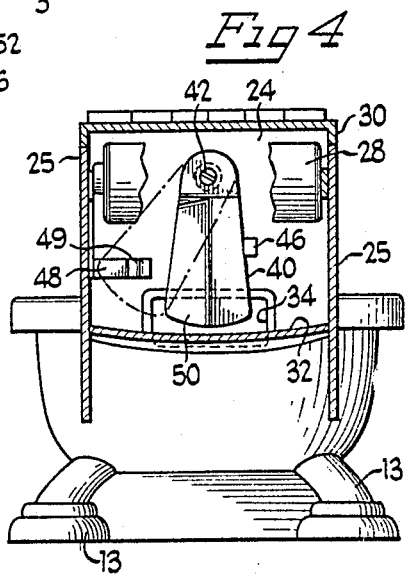
FIG. 4 is a sectional view taken generally along line 4—4 of FIG. 2.

Gate 40 is made of electrically conductive material in a truncated pie shape and is secured adjacent its smaller end by a screw 42 to a control handle or knob 44 that conveniently resembles a faucet handle. Control handle 44 is received for rotation in a bore extending through front wall 24 and gate 40 keeps the handle from being pulled out from the front. With gate 40 disposed in its generally vertical, central position, gate 40 sufficiently blocks duct 34 to prevent the passage of any of balls 36. On the inside of front wall 24, there is a stop 46 which prevents handle 44 from being rotated clockwise and gate 40 from being pivoted to the right as viewed in FIG. 4. Hence, with gate 40 in its central position, control handle or knob 44 cannot be turned in the clockwise direction but only in the counterclockwise direction which will pivot gate 40 t the left as viewed in FIG. 4 to clear duct 34 so that balls 36 may drop from tank 22 down through duct 34 and into receptacle 14.

Figure 3:
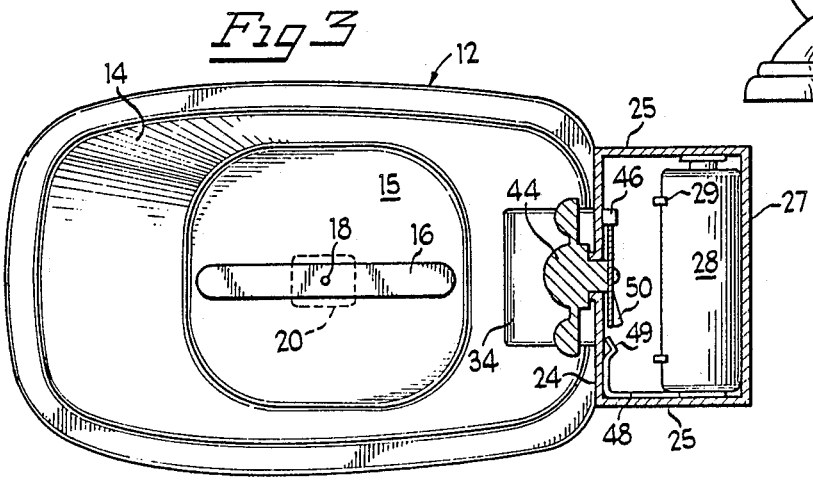
FIG. 3 is a sectional view taken generally along line 3—3 of FIG. 2.
Figure 5:
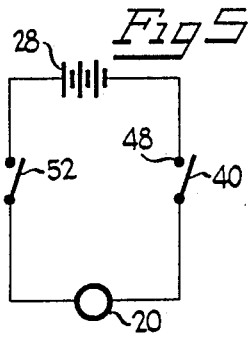
FIG. 5 is a schematic diagram of the motor control circuit.

Gate 40 is connected through suitable wiring (not shown) to motor 20. An electrical contact 48 extends from battery 28 into close proximity with the left side of gate 40 as viewed in FIG. 4. Adjacent its end proximate to gate 40, strip 48 has a raised bent portion 49. With gate 40 in its normal, generally vertical, position in which it effectively closes duct 34 to the passage of balls 36, gate 40 does not engage contact strip 48. However, when control handle 44 is rotated counterclockwise, causing gate 40 to pivot to the left as viewed in FIG. 4, gate 40 will be pivoted into engagement and electrical contact with strip 48 as indicated by the phantom line showing in FIG. 4. As is best illustrated in FIG. 3, the lower part of the side of gate 40 that will engage contact strip 48 is bent or flared slightly away from front wall 24 to facilitate it passing across the end of strip 48. Hence, as gate 40 is pivoted by the counterclockwise turning of handle 44, flared portion 50 will wipe across bent portion 49 of contact strip 48 and be maintained in electrical contact by frictional engagement until handle 44 is turned clockwise to pivot gate 40 back toward the central position breaking electrical contact and closing duct 34. Contact strip 48 is connected through wiring (not shown) to one end of battery 28 and motor 20 is connected by wiring (not shown) to the other end of battery 28. Thus, it will be appreciated that turning control handle 44 counterclockwise will result in the simultaneous release of balls 36 and turn on motor 20 to rotate impeller 16 as illustrated in the schematic diagram of FIG. 6. Conveniently, a master on/off switch 52 is also provided to protect against control handle 44 being inadvertently turned to the on position when the game is being put away.

Figure 6:
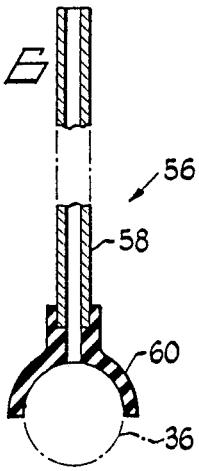
FIG. 6 is an enlarged scale, fragmentary, sectional view taken generally along line 6—6 of FIG. 1.

For collecting balls 36, each player is provided with a collector 56 in the form of a simulated plunger of the type used to free obstructions in drains. Each plunger 56 has a tubular shaft or handle 58 made of plastic or the like and a rubber suction cup 60. As best illustrated in FIG. 6, there is an opening in the top of suction cup 60 that is in communication with the opening in tubular handle 58. The interior of suction cup 60 is generally hemispherical and is of a size that conforms to that of balls 36. With the opening in the top of tubular handle 58 closed with a player's thumb or finger, the player may remove a colored ball over which suction cup 60 of plunger 56 has been positioned. As soon as the player has successfully collected a ball with the plunger and removed it from receptacle 14, the thumb or forefinger is taken off of the top of the opening in tubular shaft 58 to release the collected ball.

To play the game, a number of different colored balls 36 are placed in tank 22 and control knob 44 is rotated in a counterclockwise direction to simultaneously release the balls from the tank and turn on motor driven impeller 16. Players then use suction cup plunger 56 to pick balls of a preselected color out of the bathtub. The first player to pick out all, or a predetermined number, of the assigned color wins. Players may be penalized for removing balls of a different color to deter their removing an opponent's colored balls from play.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. An action game comprising in combination:
an open topped receptacle having a bottom;
a motor driven impeller adjacent the bottom;
a battery for providing power to the motor;
a plurality of balls;
means containing the balls outside of the receptacle;
means for the passage of the balls from the containing means into the receptacle; and
means simultaneously controlling passage of the balls from the containing means to the receptacle and power to the motor from the battery.

2. The game of claim 1 in which the control means is a pivoting gate that completes an electrical circuit between the battery and the motor when the gate is pivoted in one direction from a position blocking the passage means to a passage means open position.

3. The game of claim 2 including means preventing the pivoting of the gate from the position blocking the passage means in a direction opposite to the one direction.

4. The game of claim 2 including:
a tool for collecting the balls;
the tool having an elongated handle with opposed ends; and
a suction cup attached to one end of the handle.

5. The game of claim 4 in which:
the handle is a tubular shaft; and
the suction cup has an opening in communication with the tubular shaft.

* * * * *